US005406733A

United States Patent [19]

Tarlton et al.

[11] Patent Number: 5,406,733

[45] Date of Patent: Apr. 18, 1995

[54] FIREARM LEVELING DEVICE

[76] Inventors: A. Mac Tarlton, 26790 Wauchula Way, Hayward, Calif. 94545; Enoch M. Elton, 24546 Mission Blvd., Hayward; Donald L. Vader, 4972 Muirwood Dr., Pleasanton, both of Calif. 94544; Roger D. Walton, 1081 Galena St., Aurora, Colo. 80010

[21] Appl. No.: 92,999

[22] Filed: Jul. 19, 1993

[51] Int. Cl.[6] ..... F41G 1/44

[52] U.S. Cl. ..... 42/101; 42/1.01; 33/245; 33/292

[58] Field of Search ..... 33/240, 245, 265, 292; 42/1.01, 100, 101

[56] References Cited

U.S. PATENT DOCUMENTS

| | | | |
|---|---|---|---|
| 1,316,391 | 9/1919 | Scarr | 42/100 |
| 2,243,793 | 5/1941 | Cummins | 33/245 |
| 3,505,924 | 4/1970 | Driscoll | 42/100 |
| 3,556,666 | 1/1971 | Lichtenstern | 33/245 |
| 3,568,324 | 3/1971 | Jorczak | 33/260 |
| 4,214,372 | 7/1980 | Rusbach | 33/252 |
| 4,799,325 | 1/1989 | Booze | 42/100 |
| 5,005,308 | 4/1991 | Parks | 42/101 |
| 5,315,781 | 5/1994 | Beisner | 42/101 |

FOREIGN PATENT DOCUMENTS

| | | | |
|---|---|---|---|
| 3834924 | 4/1990 | Germany | 42/100 |

OTHER PUBLICATIONS

"Gun Digest", 16th Annual Edition, 1962, p. 371, Pacific Gun Shop Advertisement.

"Varmint Hunter", Apr. 1994, p. 64, DHB Products Advertisement.

*Primary Examiner*—Stephen C. Bentley

*Attorney, Agent, or Firm*—Terrance L. Siemens

[57] ABSTRACT

A flip-up leveling device is designed to be easily attached to an existing hand-held firearm. The purpose of the device is to eliminate sideways tilting or canting of the firearm during aiming. The device can be attached directly to the firearm or to a telescopic sight which is mounted to the firearm. A bubble spirit level is mounted on a pivoted carrying arm so it can be pivoted upward to an easily visible use position or downwardly to a protected storage and transport position. The device does not interfere with the field of view of the existing sight system it supplements. The device does not require any modification of the existing sight system.

8 Claims, 3 Drawing Sheets

FIREARM LEVELING DEVICE

BACKGROUND OF THE INVENTION

1. Field of the Invention

In its broadest aspect, this invention relates to attachments which allow precise geocentric leveling of the cant of a projectile barrel prior to firing the projectile. The projectile may be a ballistic type, such as a bullet, or a nonballistic type, such as a rocket or a laser beam. In the following specification the term "firearm" should be taken in its broadest sense as any device for imparting a forward velocity to a projectile. Included in such a definition are catapults, fire hoses, bows and arrows, guns, and laser beams in increasing order of complexity. In a laser beam the projectile is considered to be the photons of light emitted. Applications for such devices abound.

On a smaller scale, the present invention relates to the fields of hunting and target shooting with hand-held weaponry such as firearms or bows and arrows. More specifically, the invention provides an inexpensive and convenient means for accurately aiming such firearms without error due to "canting" or tilting about an axis generally, but not exactly, parallel to the line of flight of the projectile. The invention, as presented here, relies primarily on the user to provide manual correction to the cant of the weapon based upon visual cues provided by the invention.

It is contemplated that the invention could be easily mechanized by connecting the level sensing device, via a servomechanism, to an automatically powered leveling device. Such mechanization of the invention would expand its potential fields of use to include artillery, cannons, and any other device requiring accurate initial aiming of a projectile. Such a modified servo-platform would be particularly applicable to ballistic firearms normally fired from a moving platform such as helicopter gunships or naval vessels. The skilled artisan will recognize many other esoteric potential fields of use for the invention.

In a more mundane and practical sense, it is envisaged that the present invention could easily be manufactured and sold as an inexpensive kit for adding to almost any existing firearm and providing that firearm with convenient level indication means for improved accuracy.

The way the firearm is held by a shooter can have a significant effect on firearm accuracy. As will be geometrically demonstrated later, it is even possible to have an expensive telescopic sight, set perfectly for windage and range, aligned perfectly with target boundaries, aimed precisely at the bulls eye, and held perfectly motionless during firing, and still miss the target.

The accuracy of hand-held firearms is improved by an order of magnitude with the addition of a good telescopic sight. As well as means for magnification of the target, fine adjustments are possible for such effects as windage and range. The scope optics usually provide horizontal and vertical cross-hairs as a visual reference. If the shooter has a good horizontal or vertical reference within the field of view of the scope, it is a relatively simple matter to align the appropriate cross-hair with that reference to assure an accurate shot. A major problem is encountered if the assumed horizontal or vertical reference is not truly horizontal or vertical. In actual hunting practice the presence of true vertical or horizontal references in the environment is rare. In hilly or mountainous country the horizon is often not exactly horizontal. Also, the horizon is often not in the field of view of the target. Tree trunks rarely are exactly vertical in any terrain and thus do not provide a reliable reference. Even stationary shooting targets, as often found on shooting ranges, cannot be depended upon to be perfectly level. As a result the cross-hair mechanism, upon which even expensive telescopic sights rely for leveling and accuracy, is highly undependable.

Many times the only reason telescopic sights work at all is the uncanny ability of the human sense of balance to somehow perceive the vertical in spite of disorienting visual cues. Most hunters and marksmen rely heavily on their inner sense of balance to ensure that the firearm is not canted. Studies of airplane pilots reveal that the human sense of balance is easily confused by a number of influences. Not the least of these is the presence of loud noises such as is common around discharging firearms. The hunter is subjected to a myriad of disorienting influences such as fatigue, wind, rain, cold, rough and uneven terrain. The human sense of balance can easily become confused by even the mildest of the disorienting influences common to hunting and target shooting. This invention eliminates dependence on the easily confused sense of balance.

It will become immediately evident that the unique properties of the apparatus herein disclosed will provide important benefits in many areas. The conversion kit of this invention may be adapted for use in any field in which it is desired to accurately aim a ballistic projectile such as a bullet or even a nonballistic projectile such as a laser beam. As such it will be appreciated that the potential uses are myriad. A comprehensive listing of all the possible fields to which this invention may be applied is limited only by the imagination and is therefore not attempted here. Some of the more obvious applications are mentioned herein in the interest of providing a full and complete disclosure of the unique properties of this previously unknown general purpose article of manufacture. Recreational target shooting and game hunting are seen as the fields most likely to gain immediate and substantial benefit from this invention. It is to be understood from the outset that the scope of this invention is not limited to these mentioned fields or to the specific examples of potential uses presented hereinafter.

2. Description of the Prior Art

The prior art in a few instances has broadly recognized the inaccuracies introduced into the aiming of a hand-held firearm if its firing barrel is not held in a perfectly vertical plane. However, none of the prior art has offered an inexpensive and practical solution which can be easily applied to existing firearm sighting systems.

U.S. Pat. No. 5,005,308 issued to Parks on Apr. 9, 1991, teaches the need for a tilt indicator for firearm scopes and claims a solution based on electric circuitry responsive to the tilting of a mercury switch. This solution of Parks requires an electrical power source for the circuitry involved. By contrast, the instant invention requires no external power source. Parks also shows a mechanical embodiment comprising a liquid leveling device enclosed within the barrel of a telescopic sight. This solution of Parks would require the purchase of a special telescopic sight with the special liquid leveling device built in. In contradistinction, the instant invention requires no special scope or sighting device. Instead, the instant invention provides a simple but effective leveling device that can be added to any existing hand-held firearm sighting system. Additionally, the disclosure of Parks is of interest for his correct assessment that a counter-clockwise cant about the telescopic line of sight will cause the bullet projectile to miss the target low and to the left. The disclosure of Parks is herein incorporated by reference for his discussion of the geometry of the situation.

U.S. Pat. No. 4,214,372 issued to Rusbach on Jul. 29, 1980, recognizes that trajectory type firearms must be fired with the weapon barrel in a vertical plane for accuracy. Rusbach provides for such leveling only in a crude liquid containing transparent container of considerable width as best seen in Rusbach's FIG. 24. Markings along the outer edges of the container allow the marksman to determine if the sighting device is canted prior to firing. This is similar to leveling a jug of water by assuring the water height is the same on each side of the jug. During the time the eyes focus from one side of the jug to the other, the jug must be held perfectly motionless. In practice, it is difficult, if not impossible, to align on a target and then check both sides of a liquid container at once while simultaneously holding a firearm motionless. Of course, if the width of the liquid container is reduced, the visual cues become easier to obtain but the accuracy of the leveling is sacrificed. Surface tension effects of the liquid become significant in a narrow liquid container so as to destroy the effectiveness of the intended operation. By contrast, the bubble type spirit level of the instant invention provides an easily seen accurate indication of level without requiring the eye to be continually refocused. The Rusbach leveling device is also formed as an integral part of his complex overall sighting mechanism and thus cannot be attached to another existing sighting system as is the intent of a notable feature of the instant invention.

U.S. Pat. No. 3,556,666, issued to Lichtenstern on Jan. 19, 1991, shows a telescopic gunsight with a built-in adjustable level means including interior illumination. The complex level means is formed as an integral part of the gunsight so as to be visible in the optical field of view of the scope thus unduly restricting a shooter's vision. The integral construction prevents the level of Lichtenstern from being attached to a different existing sighting system, whereas the visibility of the level indicator within the optical field of view reduces the size and usefulness of the view field for other uses particularly crucial to hunting, such as target acquisition. By contrast, it is easily possible and intended that the present invention be added to existing sighting systems. Also, the original field of view is left entirely unrestricted by the invention presented here.

U.S. Pat. No. 3,568,324, issued on Mar. 9, 1971 to Jorczak, shows a flip-up auxiliary sight attachment for hand-held firearms. Although the attachment is not used for leveling the firearm, the type of flip-up hinge and bracket used would be suitable for mounting the leveling device of the instant invention. The disclosure of Jorczak is hereby incorporated by reference.

U.S. Pat. No. 2,243,793, issued to Cummins on May 27, 1941, shows an early cant indicator for telescopic rifle sights. The pendulum leveling means must be formed as an integral part of the scope with a slot cut in the scope barrel thus preventing the leveling device from being easily added to existing sighting devices. In addition, the pendulum rod indicator interferes with normal vision of the scope cross-hairs and there is no way to move the leveling device to an unobtrusive non-use position. By contrast, the instant invention does not interfere with the normal sight field of view and can be easily pivoted out of the way for transport or storage.

None of the above inventions and patents, taken either singly or in combination, is seen to anticipate or make obvious the instant invention as claimed.

SUMMARY OF THE INVENTION

The preferred embodiment of this invention provides a leveling device in the form of a conversion kit suitable for adding to an existing sighting device or to a firearm containing an existing sighting device. The device, once added to the firearm, is capable of being easily flipped to a convenient use position and flipped back to a non-protruding position for transport and storage. Briefly, the leveling device comprises:

(1) a mounting bracket for attachment directly to an existing firearm or to a sighting system, such as a telescopic sight, already mounted on a firearm;

(2) a carrying arm connected at one end to said mounting bracket by pivot means and carrying, at the other end, leveling means;

(3) said pivot means comprising detent means for releasably locking said carrying arm and said leveling means alternately in an extended easily visible position for use and a retracted non-protruding position for transport and storage; and (4) said leveling means comprising a bubble spirit level and providing a visible indication of the level position without interfering with the field of view of the existing sighting system or requiring movement of the user's eye from alignment with the existing sighting system.

The materials used for the components of this invention are conventional and generally chosen to provide adequate service at minimum cost. The leveling device of this invention overcomes the disadvantages of the prior art by meeting or exceeding all the following objectives:

Accordingly, it is a principal object of the invention to provide a new and improved apparatus for leveling a firearm.

A major object of this invention is to provide a new and improved apparatus for converting existing firearm sighting systems without leveling capability to sighting systems with leveling capability.

Another object of the invention is to provide such an apparatus capable of providing leveling information to the user without usurping any of the field of vision provided by the existing sighting system or requiring movement of the user's eye from alignment with the existing sighting system.

Another object is to provide such an apparatus with the capability of being extended to an easily visible use position and retracted to a safe non-protruding transport position.

Another object is to provide such an apparatus with a simple but foolproof safety detent mechanism for positively holding the exposed mechanism in a retracted position and preventing accidental catching on foreign objects during transport, even in dense underbrush.

Another object is to provide such an apparatus with a simple but foolproof detent mechanism for positively, repeatedly, and accurately holding the leveling apparatus in a precise easily visible use position under all conditions.

Still another object of the invention to provide the apparatus above such that it may be inexpensively manufactured and sold in conversion kit form.

A further object of the invention to provide such an apparatus capable of being quickly and easily installed, even on complex existing sight systems, without any major modification to the main system components.

Finally, it is a general object of the invention to provide improved elements and arrangements thereof in an apparatus for the purposes described which is inexpensive, dependable and fully effective in accomplishing its intended purposes.

It is submitted that the present invention meets or exceeds all the above objects and goals. Upon further study of the specification, drawings, and appended claims, further objects and advantages of the invention will become apparent to those of ordinary skill in the art.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figures 1, 2:
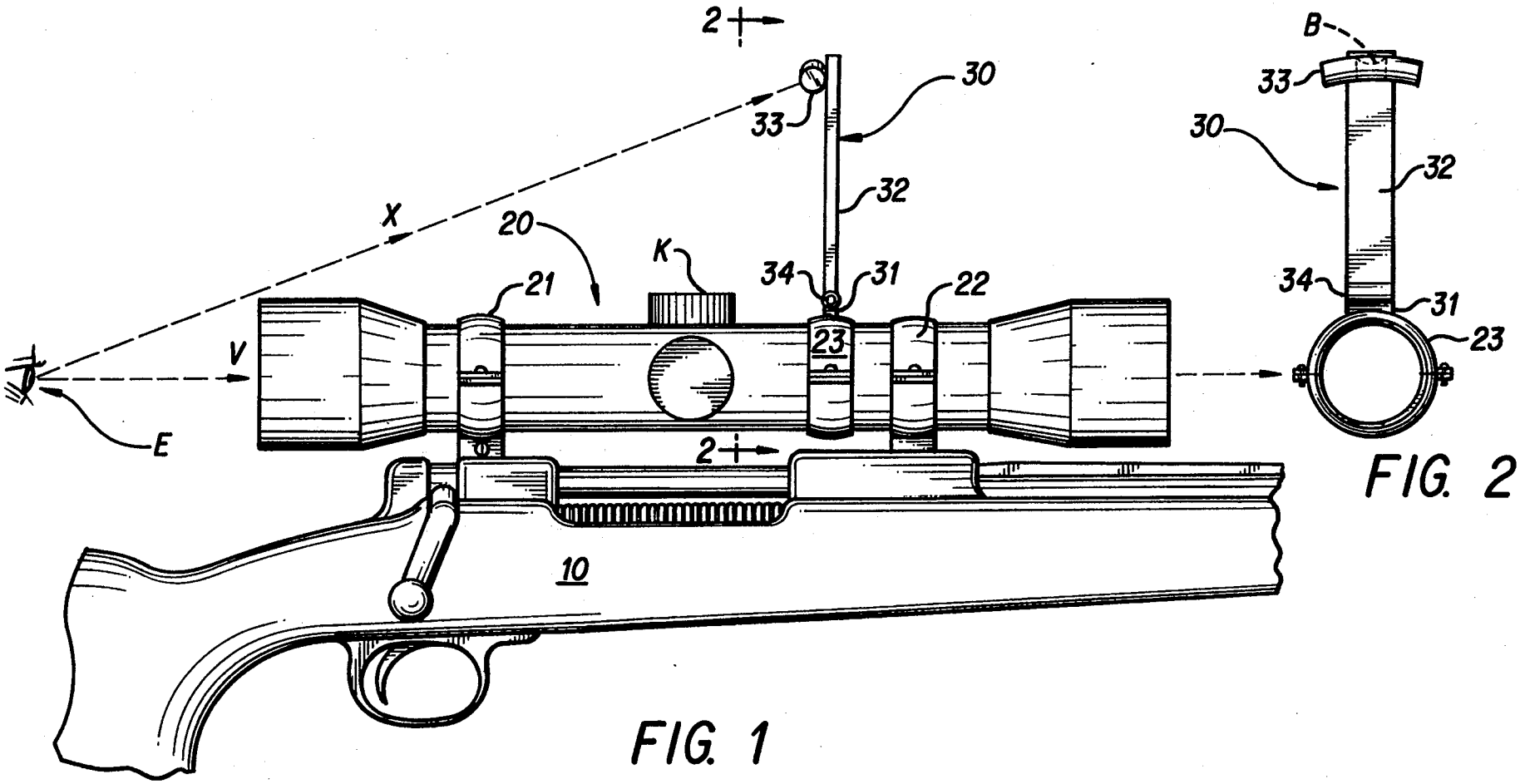
FIG. 1 is side environmental view showing a partially broken-away rifle with a telescopic sight and a scope ring mounting for a first embodiment of the invention.
FIG. 2 is a shooter's eye view taken along lines 2—2 of FIG. 1.

The present invention is shown in three separate embodiments in FIGS. 1 and 2, FIGS. 3 and 4, and FIGS. 5 and 6, respectively. The basic invention is essentially identical in all three embodiments with minor variations to accommodate different ways of mounting the invention to a conventional existing firearm 10. FIGS. 1 and 2 illustrate leveling device 30 attached to conventional telescopic sight 20 which, in turn, is attached to conventional firearm 10 by rear and front scope rings 21 and 22, respectively. The attachment of the leveling device 30 to telescopic sight 20 is made with barrel ring 23. Barrel ring 23 is similar in size and construction to front and rear scope rings 21, 22 in that it is made up of upper and lower half rings which are detachably connected to one another as by screws or other fastening means so as to encircle the barrel of sight 20. Barrel ring 23 differs from scope rings 21, 22 in that upstanding mounting bracket 31 is securely affixed atop the upper portion of barrel ring 23. The means for affixing bracket 31 could be welding, brazing, or another permanent type of connection. This is because, in this embodiment of the invention, the leveling means 30 and its barrel ring 23 will be factory manufactured. The addition of the leveling device to the existing sight will be accomplished in the field by attaching the barrel ring 23 to the telescopic sight barrel at a convenient location along the length thereof.

Carrying arm 32 is pivotally attached at its lower end to mounting bracket 31 by pivot means 34 shown here only schematically. Pivot means 34 includes detents to hold arm 32 upstanding as shown in FIGS. 1–6 or, alternately, to hold arm 32 pivoted downward against the scope barrel for transport or storage. Details of a suitable pivot detent mechanism may be seen in U.S. Pat. No. 3,568,324 issued to Jorczak, which has been incorporated by reference. In the embodiments shown the pivoting would occur about axis 34 forward (clockwise) about 90 degrees so the arm 32 will rest against the forward end of the existing telescopic sight. This is done here merely to avoid interference with the upwardly projecting adjustment knob K on the existing telescopic sight. Of course different existing sight systems will have different mounting interferences and it is obvious that the barrel ring 23 could be reversed so as to obtain pivoting in the opposite direction if desired. It is also recognized that some existing sighting systems could require a more complex mechanism, such as a double hinge, to adequately fold the level mechanism out of the way. Such more complex mechanisms are considered well within the spirit and scope of this invention.

Carrying arm 32 may be fashioned as a simple solid rectangular bar of relatively thin cross-section cooperating with pivot means 34 at its lower end and adapted to have spirit level 33 attached on the rear face near its upper end. The leveling device of this invention may being mounted directly to the body of a firearm which uses conventional peep sights. In this case, the manner that Jorczak's flip-up sight is mounted would be suitable. Also, it is proposed to fashion carrying arm 32 with a hollowed out lower portion so as not to interfere with the normal use of an existing peep sight. Details of such a configuration for the carrying arm are given in Jorczak, which has been incorporated by reference. Another possibility would be to form the carrying arm from a transparent material.

Near the upper end of carrying arm 32 is mounted bubble spirit level 33. Transparent contact cement of the type used between automotive windshields and rear view mirrors should provide a satisfactory connection between the bar face and the spirit level. Of course any other suitable means of attachment could be used and still be considered within the scope of this invention.

Spirit level 33 is similar to the inside portion of a common carpenter level. Bubble B captured in a liquid filled transparent toroidal segment cavity of spirit level 33 will naturally float to the uppermost portion of the cavity. Two indicia lines, one bubble width apart, are etched or scribed on the cavity so that when the firearm barrel is in a vertical plane the bubble may be seen resting between the two lines as is well known to the artisan. It is contemplated that for this application the encased liquid should be slightly more viscous than water so as to dampen oscillations of the bubble caused by rapid firearm movement. The liquid also should have a low freezing point so as to be operable when hunting outdoors in the winter. Ideally, the liquid should also be a bright color so as to be easily discernable in dim lighting. A solution containing ethylene glycol would be one possible liquid meeting the above conditions but others will occur the skilled artisan.

An important feature of this invention is that the leveling device may be seen without moving the eye from alignment with the target sight line and that the leveling device does not cover or interfere with in any way the field of view of the existing sighting system. This is illustrated in FIG. 1 by eye E, symbolically representing the position of a shooter's eye along target view line V. As can be seen from the Figure, viewing the leveling device 33 along line X is possible without moving the eye position from line V.

Figure 4:
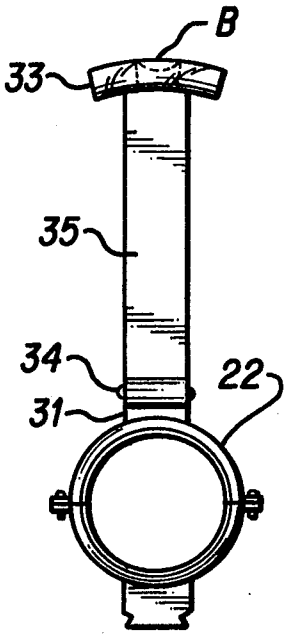
FIG. 4 is a shooter's eye view taken along lines 4—4 of FIG. 3.
Figure 3:
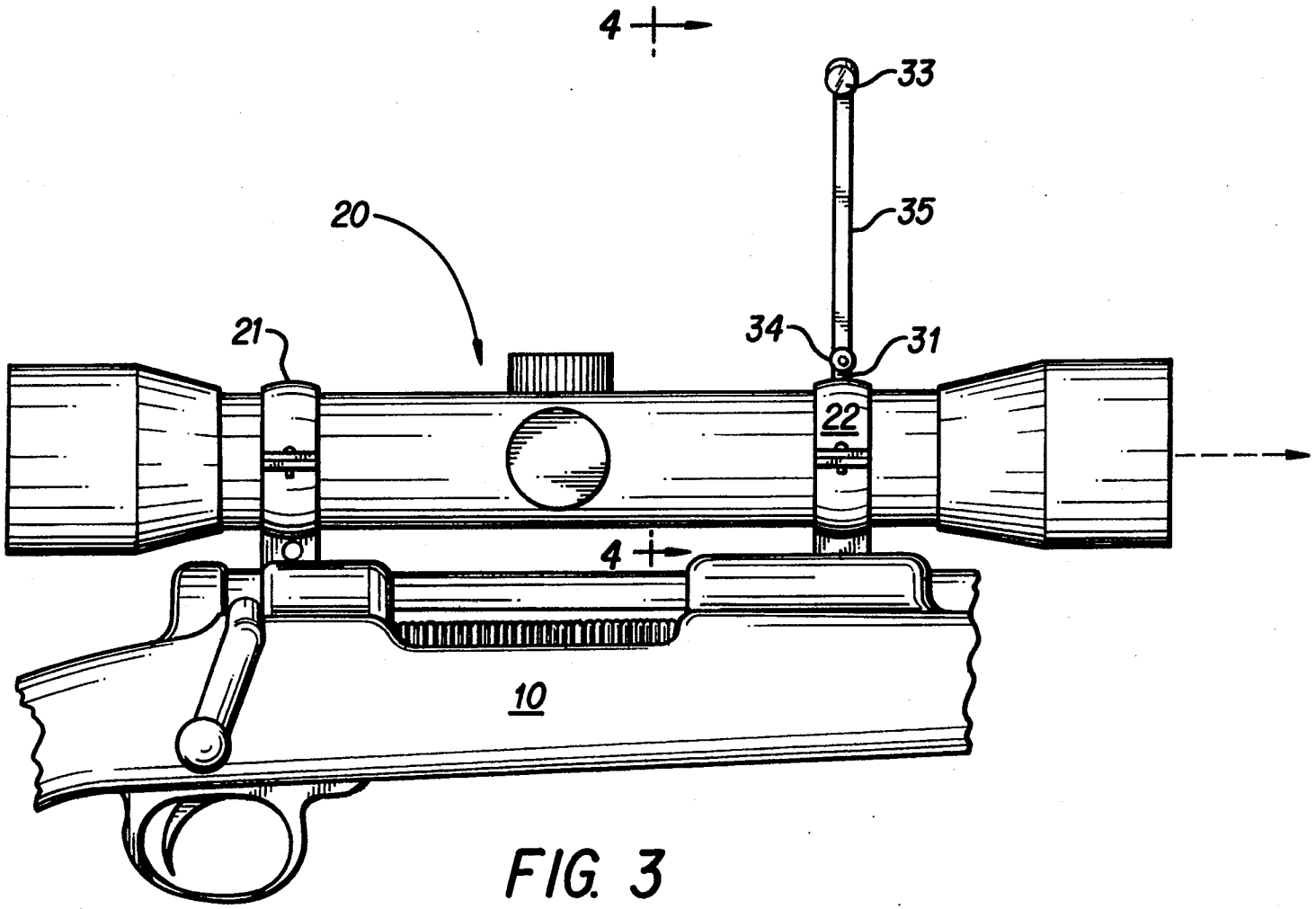
FIG. 3 is side environmental view showing a partially broken-away rifle with a mounting for a second embodiment of the invention to an existing telescopic sight ring.

FIGS. 3 and 4 show a second embodiment of the invention in which the leveling device is attached directly atop the upper portion existing forward scope barrel ring 22. Of course, this sort of attachment could not be done in a factory unless the existing telescopic sight and its mountings, or perhaps the entire firearm, were shipped to the factory. This being the case, the attachment between mounting bracket 31 and barrel ring 22 is contemplated as being one more amenable to field installation than the welding or brazing of the previous embodiment. Some sort of holding jig might be provided with the kit to precisely hold mounting bracket in position while it is cemented or otherwise fixed to barrel ring 22.

The second embodiment also shows a slightly different method of fixing the leveling device 33 to slightly different carrying arm 35. Carrying arm 35 differs from carrying arm 32 of the first embodiment only in that the upper surface of the generally rectangular bar is rounded so as to accomodate the natural bow of the inner radius of the toroidal segment forming the leveling device 33. The leveling device 33 is attached to the rounded top of carrying arm by contact cement or any other convenient method. One advantage of this mounting position of leveling device 33 is that it maximizes the visibility of the leveling device for a given length carrying arm 35.

Figure 6:
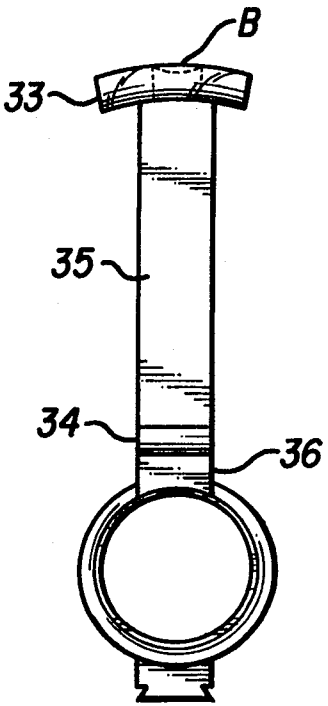
FIG. 6 is a shooter's eye view taken along lines 6—6 of FIG. 5.
Figure 5:
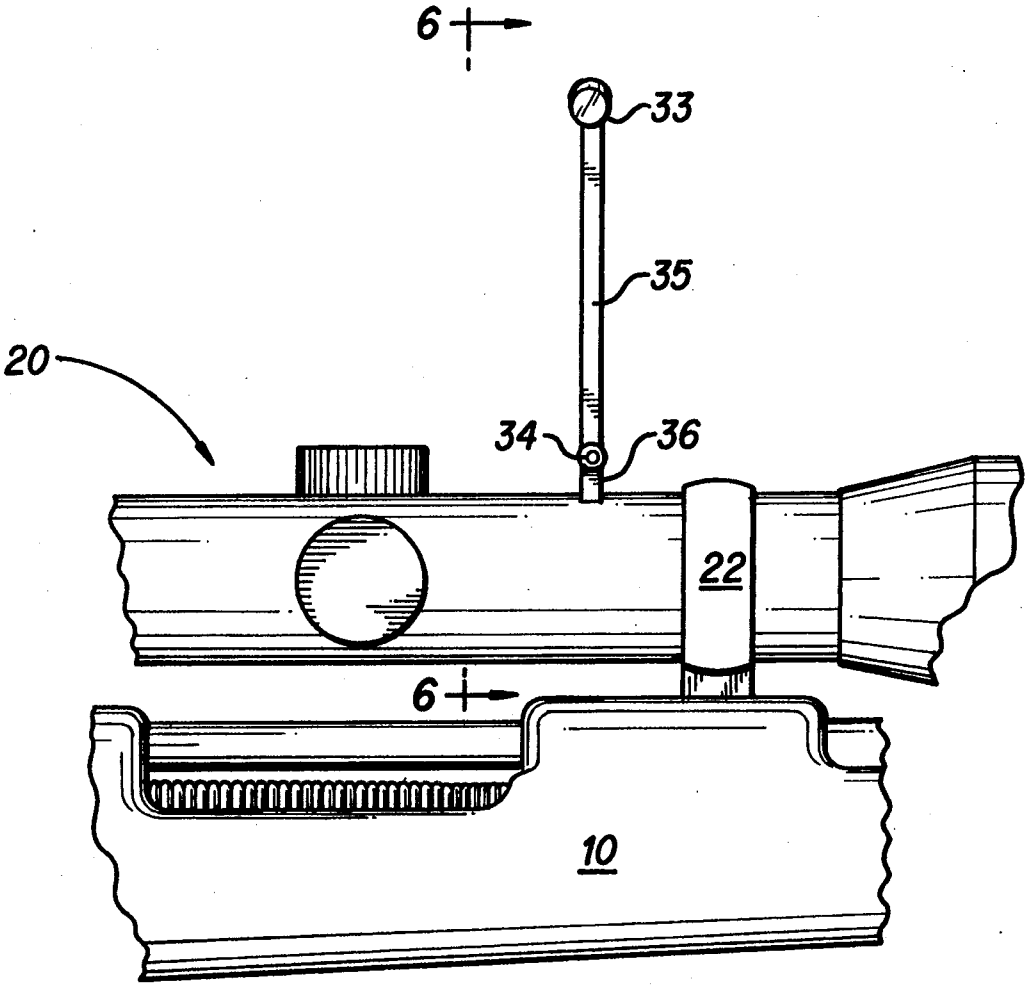
FIG. 5 is side environmental view showing a partially broken-away rifle showing a mounting for a third embodiment of the invention to an existing telescopic sight barrel.

A third embodiment of the invention is illustrated in FIGS. 5 and 6. In this embodiment slightly modified mounting bracket 36 is attached directly to the telescopic sight barrel. The slight modification involves a slighty smaller radius of curvature of the lower portion of the mounting bracket so as to conform with the slightly lesser radius of the scope barrel as opposed to a scope barrel ring. This embodiment, like the second, is adapted (as with a jig, etc.) to make the attachment in the field as opposed to in the factory. The leveling device 33 is attached atop the carrying arm 35 in the same manner as the second embodiment.

In operation the invention simply gives the shooter a visual cue indicating whether the firearm barrel is in a vertical plane. If the firearm barrel is not in a vertical plane an error will be caused by any conventional sighting system. This is because the line of sight for a ballistic projectile is, by necessity, not parallel to the firearm barrel. As soon as a ballistic projectile leaves the firearm barrel it begins to drop due to the force of gravity. As a matter of fact, the projectile drops at the same rate as it would if it were merely released by hand from the same height. The firearm barrel must be inclined upwardly with respect to the target line of sight by an amount just appropriate to compensate for the amount of gravitational drop during the time it takes the projectile to reach the target. Since the time of flight is a function of the distance to the target, the correct inclination compensation varies for different distances to the target. The upward inclination of the firearm barrel is often called the elevation or distance setting. For purposes of this discussion it is sufficient to realize that the inclination must be present. The line flight induced by the firearm barrel and the line of sight to the target are always at an angle to one another. Usually, the line of sight to a target is horizontal and the firearm barrel is is inclined upwardly beneath the sight line and in the vertical plane containing the sight line. If the distance setting is correct, the projectile should strike the target. The vertical plane containing the flight path coincides with the vertical plane containing the sight path and the firearm barrel.

Now assume that the firearm is rotated about the sight line as might be induced by a false visual indication or a faulty sense of balance. For the sake of argument, assume a rotation about a horizontal sight line of a full 90 degrees counter-clockwise. The firearm barrel, originally beneath the sight line and inclined upwardly, now lies to the right of the sight line and is inclined to the left. The upward inclination being transformed to leftward inclination explains why counterclockwise rotation causes the projectile to miss the target to the left. Also note the original upward inclination is no longer present because in the 90 degree rotated position the firearm barrel actually lies in a horizontal plane. This transformation from a upward (distance) inclination to a horizontal inclination explains why counter-clockwise rotation causes the projectile to be low of the target. In practice, unintentional rotation or canting of the firearm will be much less than 90 degrees but any inclination will begin to introduce the effects discussed.

By using the simple leveling device of this invention the marksman or hunter can substantially eliminate any error caused by canting of the firearm. It is also contemplated that the device could also be useful as a training aid for the firing of any hand-held firearm, such as by police or military marksmen. Practice firing of a weapon equipped with this invention should assist in developing a "feel" for the weapon's verticality and thus improve marksmanship on similar weapons not so equipped.

It is to be understood that the present invention is not limited to the sole embodiments described above, but encompasses any and all embodiments within the scope of the following claims.

We claim:

1. A leveling device for a firearm with a firing barrel and an attached telescopic sight, comprising;

a mounting bracket attached to said telescopic sight with barrel ring means surrounding a barrel of said telescopic sight;

a carrying arm connected at one end to said mounting bracket by connection means and carrying, proximate the other end, leveling means; wherein said leveling means provides a visible indication of a level position outside the field of view of the existing sighting system requiring no movement of a user's eye from alignment with the target line of the existing sighting system; and wherein said mounting bracket, said carrying arm, and said leveling means are arranged so that said indication of a level position always corresponds to a position where the firing barrel of the firearm is situated in a vertical plane.

2. The leveling device according to claim 1, wherein said connection means comprises;

pivot means for pivoting said carrying arm and said leveling means alternately between an extended easily visible position for use and a retracted non-protruding position for transport and storage.

3. The leveling device according to claim 1, wherein said leveling means comprises;

a bubble spirit level providing said visible indication of the level position by the position of a bubble with respect to reference indicia.

4. The leveling device of claim 3 wherein, said carrying arm is shaped as a substantially rectangular bar and said bubble spirit level is attached to a wide side face of said bar so as to be visible by the user of the firearm.

5. The leveling device according to claim 1, wherein said mounting bracket is connected by screw fasteners so as to be easily attached to said firearm in the field with simple hand tools, thus effectively forming a kit for conversion of a sight system without leveling capability into a sight system with leveling capability.

6. In combination:

a rifle with a firing barrel and a sighting system, a telescopic sight mounted on said rifle, a leveling means mounted on said telescopic sight, wherein said leveling means provides a visible indication of a level position outside the field of view of said sighting system requiring no movement of a user's eye from alignment with the target line of said sighting system, and said leveling means is arranged so that said indication of a level position always corresponds to a position where said firing barrel of said rifle is situated in a vertical plane and also including a pivot means for attaching said leveling means to said telescopic sight and for swinging said leveling means alternately between an extended easily visible position for use and a retracted non-protruding position for transport and storage.

7. The combination of claim 6, wherein said leveling means comprises;

an elongated carrying arm having first and second ends, said first end being connected to said pivot means;

a bubble spirit level attached to said carrying arm proximate said second end.

8. The combination of claim 6 wherein said leveling means comprises;

an elongated carrying arm having first and second ends, said first end being connected to said pivot means;

a bubble spirit level attached to said carrying arm proximate said second end.

* * * * *